US009604125B2

(12) United States Patent
Page et al.

(10) Patent No.: US 9,604,125 B2
(45) Date of Patent: Mar. 28, 2017

(54) ACCESSORY MOUNTING ASSEMBLY FOR SKATEBOARDS

(71) Applicant: ShredLife, Inc., San Diego, CA (US)

(72) Inventors: Andrew T. Page, San Diego, CA (US); Kyle Kitzmiller, San Diego, CA (US)

(73) Assignee: ShredLife, Inc., San Diego, CA (US)

( * ) Notice: Subject to any disclaimer, the term of this patent is extended or adjusted under 35 U.S.C. 154(b) by 0 days.

(21) Appl. No.: 14/973,732

(22) Filed: Dec. 18, 2015

(65) Prior Publication Data

US 2016/0175693 A1 Jun. 23, 2016

Related U.S. Application Data

(60) Provisional application No. 62/095,674, filed on Dec. 22, 2014.

(51) Int. Cl.

| | |
|---|---|
| ***A63C 17/26*** | (2006.01) |
| *A63C 17/00* | (2006.01) |
| *A63C 17/01* | (2006.01) |

(52) U.S. Cl.

CPC ..... *A63C 17/26* (2013.01); *A63C 17/0093* (2013.01); *A63C 17/012* (2013.01); *A63C 17/015* (2013.01); *A63C 2203/14* (2013.01)

(58) Field of Classification Search

CPC ..... A63C 17/26; A63C 17/01; A63C 17/012; A63C 17/017

USPC ..... 280/87.042

See application file for complete search history.

(56) References Cited

U.S. PATENT DOCUMENTS

| | | | | | |
|---|---|---|---|---|---|
| 4,240,132 | A * | 12/1980 | Wickman | A63C 17/26 | 280/11.203 |
| 4,336,573 | A | 6/1982 | Carter | | |
| 4,817,974 | A | 4/1989 | Bergeron | | |
| 4,824,139 | A * | 4/1989 | Robbins | A63C 17/26 | 280/816 |
| 4,836,075 | A * | 6/1989 | Armstrong | G10H 1/00 | 200/61.52 |
| 4,991,066 | A | 2/1991 | McCowan | | |
| 4,997,196 | A | 3/1991 | Wood | | |
| 5,067,058 | A | 11/1991 | Standley | | |
| 5,119,277 | A * | 6/1992 | Copley | A63C 17/26 | 280/87.042 |

(Continued)

OTHER PUBLICATIONS

Ekick, Accessed on Nov. 19, 2014, http://www.ekicktech.com/#preorder.

(Continued)

*Primary Examiner* — J. Allen Shriver, II
*Assistant Examiner* — Brian Cassidy
(74) *Attorney, Agent, or Firm* — The Mueller Law Office, P.C.

(57) ABSTRACT

An accessory assembly for a skateboard includes a bracket configured to be mounted to a first surface of a base plate of a skateboard truck. The first surface is opposite a second surface of the base plate, where the second surface faces a deck of the skateboard when mounted to the skateboard. The bracket includes a mounting hole and a receiving element, and is configured to span only a portion of a perimeter of the base plate. An accessory component includes a housing having an engaging element, the engaging element being configured to be removably coupled with the receiving element. An accessory is mounted to the housing.

19 Claims, 9 Drawing Sheets

(56) References Cited

U.S. PATENT DOCUMENTS 5,130,693 A * 7/1992 Gigandet ..... G08B 7/06 340/326
5,132,883 A * 7/1992 La Lumandier ..... A63C 17/26 280/87.042
5,278,733 A * 1/1994 St. Thomas ..... A63C 17/26 280/11.19
5,327,329 A * 7/1994 Stiles ..... A63C 17/26 280/809
5,513,080 A 4/1996 Magle et al.
5,642,928 A * 7/1997 Hylton ..... B60Q 1/50 362/227
5,921,669 A * 7/1999 Taylor ..... B62J 6/00 362/191
6,540,384 B1 * 4/2003 Rosevear ..... A63C 11/00 362/190
6,802,636 B1 * 10/2004 Bailey, Jr. ..... A63C 17/01 280/841
6,828,916 B2 * 12/2004 Rains ..... A63C 17/01 340/384.1
7,995,787 B2 * 8/2011 Ierfone ..... A63C 17/26 340/432
8,038,313 B1 10/2011 Campbell
8,506,140 B2 * 8/2013 Edmisten ..... A63C 5/06 280/816
8,770,808 B1 * 7/2014 Campbell ..... B62J 6/04 362/473
8,777,442 B2 7/2014 Khan
8,974,098 B2 * 3/2015 McCaslin ..... B62J 6/003 362/184
9,447,962 B2 * 9/2016 Kim ..... F21V 33/008
2003/0185019 A1 * 10/2003 Rogers ..... A63C 17/0093 362/545
2003/0201620 A1 * 10/2003 Seelye ..... A63C 17/01 280/87.042
2004/0100055 A1 * 5/2004 Chang ..... A63C 17/01 280/87.042
2004/0100792 A1 * 5/2004 Trzecieski ..... A43B 1/0036 362/103
2008/0036165 A1 * 2/2008 Reinson ..... A63C 17/01 280/87.042
2008/0150255 A1 * 6/2008 Hogenmiller ..... A63C 11/003 280/611
2008/0265539 A1 * 10/2008 Gregorio ..... A63C 17/26 280/87.041
2009/0236811 A1 * 9/2009 Lewis ..... A63C 17/0093 280/87.042
2011/0141751 A1 * 6/2011 Wei ..... B62J 6/02 362/428
2011/0221150 A1 * 9/2011 Harris ..... A63C 17/0093 280/87.042
2012/0092886 A1 * 4/2012 Calhoun ..... A63C 17/26 362/549
2016/0121198 A1 * 5/2016 Doerksen ..... A63C 17/01 701/22
2016/0195246 A1 * 7/2016 Carattini ..... F21S 48/30 362/486

OTHER PUBLICATIONS

Monolithic LCC, Skate Ray—a rechargeable headlight for your skateboard, Accessed on Nov. 19, 2014, https://www.kickstarter.com/projects/1870928522/skate-ray.

Photon Light Board LED Skateboard(Deck Only)—Crop Circles 1 Long Board (9.5inX42.5in), Accessed on Nov. 19, 2014, http://www.amazon.com/Photon-Light-Board-Skateboard-Deck/dp/B001QOQ8JG.

Sunset Skateboard, Accessed on Nov. 19, 2014, http://www.sunsetskateboards.com/index.php/.

* cited by examiner

ACCESSORY MOUNTING ASSEMBLY FOR SKATEBOARDS

RELATED APPLICATIONS

This application claims priority to U.S. Provisional Patent Application No. 62/095,674 filed on Dec. 22, 2014 and entitled "Lighting Assembly for Skateboards," which is hereby incorporated by reference for all purposes.

BACKGROUND OF THE INVENTION

A road surface upon which a skateboarder rides presents potential hazards to the rider. Obstacles or defects such as cracks in a sidewalk can cause serious injury if the obstacle is not sighted in time to avoid it. To improve visibility, some skateboards have been made with diodes embedded into the wooden deck of the skateboard. In other known art, a riser pad is mounted between the skateboard's deck and wheel truck, where a light is built into the riser pad. Further designs include lights embedded within the skateboard wheels.

Yet there continues to be a need for providing illumination for skateboards, so that skateboards may be safely used in dim or darkened environments.

SUMMARY

An accessory assembly for a skateboard includes a bracket configured to be mounted to a first surface of a base plate of a skateboard truck. The first surface is opposite a second surface of the base plate, where the second surface faces a deck of the skateboard when mounted to the skateboard. The bracket includes a mounting hole and a receiving element, and is configured to span only a portion of a perimeter of the base plate. An accessory component includes a housing having an engaging element, the engaging element being configured to be removably coupled with the receiving element. An accessory is mounted to the housing.

In some embodiments, the accessory assembly is a lighting assembly for a skateboard, the assembly including a bracket configured to be mounted to a first surface of a base plate of a skateboard truck. The first surface is opposite a second surface of the base plate, the second surface facing a deck of the skateboard when mounted to the skateboard. The bracket includes a mounting hole and a receiving element, and is configured to be mounted onto the first surface of the base plate without removing the skateboard truck from the skateboard. A lighting component has a housing having an engaging element, the engaging element being configured to be removably coupled with the receiving element. A lighting element is mounted to the housing.

In some embodiments, the accessory assembly is a lighting assembly for a skateboard, the assembly including a bracket having a receiving element. A lighting component includes a housing having an engaging element, where the lighting element is mounted to the housing. The engaging element of the housing is configured to be removably coupled with the receiving element of the bracket. The lighting assembly also includes a coupling element configured to mount the bracket to a first surface of a base plate of a skateboard truck, where the first surface is opposite a second surface of the base plate, the second surface facing a deck of the skateboard. When the bracket is being mounted onto the first surface of the base plate, the skateboard truck is not removed from the skateboard.

DETAILED DESCRIPTION OF THE EMBODIMENTS

An accessory mounting assembly is disclosed that is easily installed onto the truck area of a skateboard, using the existing hardware of the skateboard and avoiding the need to dismantle the skateboard itself. The accessory assembly, such as a lighting assembly, is protected by the truck area, making it durable while leaving the skateboard deck free for use during riding and performing tricks. The accessory assembly includes a bracket that is mounted to the base plate of the truck, and an accessory component that may be easily attached or removed from the bracket while the bracket remains attached to the skateboard. In various embodiments, the accessory assembly may be mounted to the bracket using elastic materials, quick release mechanisms, or magnets. The accessory assembly may be mounted on any type of skateboard, can accommodate various wheel sizes and truck sizes, and in some embodiments can project light 360 degrees around the skateboard. Although the present disclosure will be described in terms of a skateboard, the disclosure may also be applied to longboards, roller skates, scooters, pull wagons, or other wheeled recreational items. In addition, although the present disclosure will be described in terms of mounting a lighting attachment, the disclosure may also be applied to mounting other accessories such as cameras, audio devices, global positioning system (GPS) equipment, and wireless (e.g., Bluetooth) devices. The accessories may or may not have capabilities to connect to web and mobile applications, cloud data storage, and other electronic devices.

Figure 1:
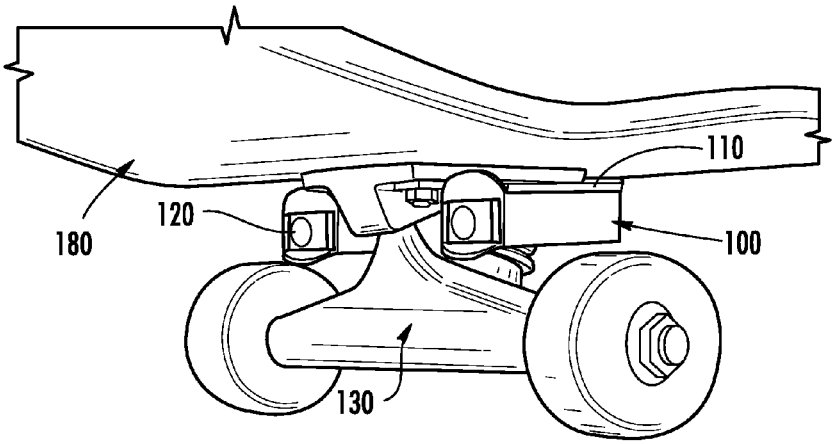
FIG. 1 is a perspective view of an exemplary accessory assembly, embodied as a lighting assembly, mounted on a skateboard.

FIG. 1 shows an embodiment of an accessory assembly 100 mounted to a skateboard 180. The accessory assembly 100 includes a bracket 110 and an accessory component 120. As can be seen in FIG. 1, the accessory assembly 100 is coupled to the wheel area, also referred to as the truck 130, of the skateboard 180.

Figure 2:
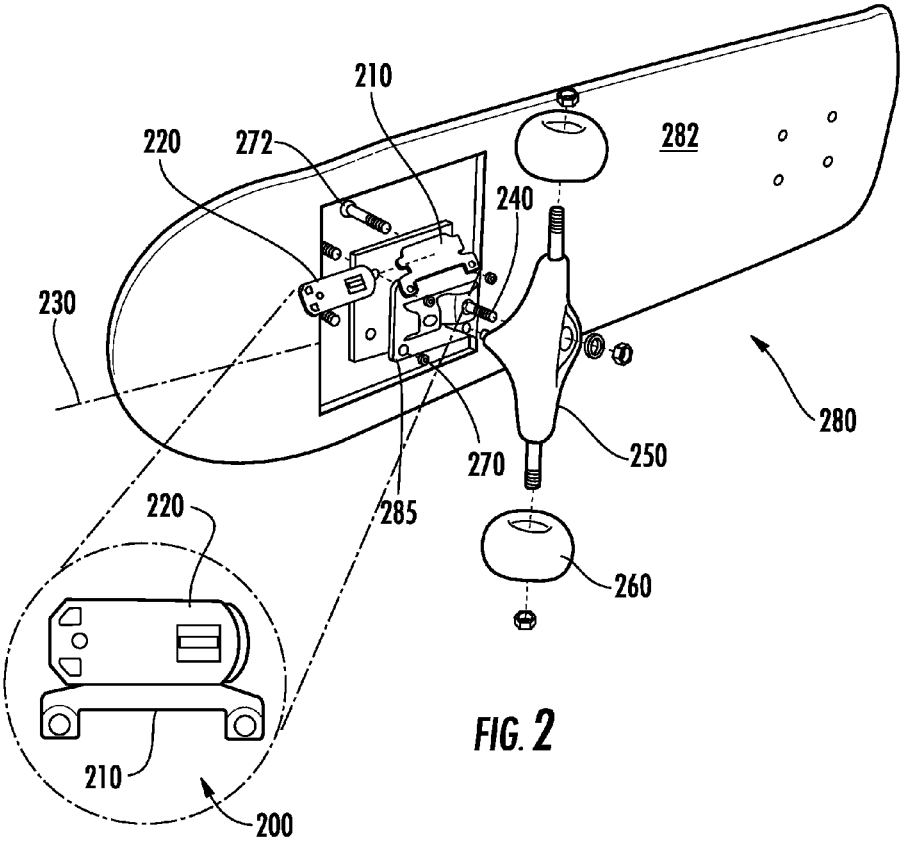
FIG. 2 shows an exploded view of a lighting assembly and skateboard, viewed from the underside of the skateboard.

FIG. 2 provides an exploded view of an exemplary embodiment of a skateboard and an accessory mounting assembly, embodied as a lighting assembly. A skateboard 280 includes a deck 282 and base plate 285 to which the skateboard truck 250 and wheels 260 are attached. A lighting assembly 200 includes a bracket 210 and lighting component 220. The bracket 210 is configured to be mounted to a first surface of the base plate 285 of the skateboard truck assembly, where the first surface is the side of the base plate 285 facing the wheels 260. The first surface of base plate 285 is visible in FIG. 2 and is opposite a second surface of base plate 285, where the second surface—that is, the back side (not shown)—faces the deck 282 when the base plate 285 is mounted to the skateboard 280. That is, the lighting assembly 200 is mounted over the base plate 285, such that the base plate 285 is between the bracket 210 and the deck 282 of the skateboard 280.

To install the lighting assembly 200, the user needs only to remove the nuts 270 that are used with bolts 272 to hold the base plate 285 to the skateboard 280. The user places the bracket 210 onto the base plate 285 and aligns them with the bolts 272 of skateboard 280, and then re-attaches the nuts 270. Thus, the lighting assembly 200 can be installed onto the skateboard 280 without disassembling the skateboard itself. Rather, only the nuts 270 of the truck assembly need to be removed. Also, the bracket 210 is attached to the truck 250 using the existing hardware of the skateboard, which simplifies installation. Note that other fasteners may be substituted for bolts and nuts, such as a cotter and clevis pin. Coupling elements for mounting the bracket 210 to the first surface of base plate 285 may include, for example, inserting the bolt 272 and nut 270 of the skateboard 280 through a mounting hole of the bracket 210; adhering the bracket 210 onto the first surface of base plate 285 such as by an adhesive, welding or soldering; or using a clamp or clip to fasten the bracket 210 onto existing hardware of the base plate 285 of the skateboard truck 250.

Bracket 210 is sized to span only a portion of a perimeter of the base plate 285. That is, bracket 210 does not cover the entire base plate 285, nor does it surround the kingpin 240 that couples the truck to the skateboard. Instead, the bracket 210 is configured to cover a portion of the base plate 285, such as along one edge, so that bracket 210 can be mounted onto the first surface of the base plate 285 without removing the skateboard truck 250 from the skateboard 280. In other embodiments, the bracket 210 may span more than one edge or may cover more surface area than as shown in FIG. 2, such as to provide additional stability for the lighting assembly 200. A longitudinal axis 230 is also shown in FIG. 2, representing the lengthwise centerline of the skateboard 280. In this embodiment, the bracket 210 is configured to be located on only one side of the longitudinal axis 230. Being located on only one side of the axis 230 enables the bracket 210 to be mounted to the side of the kingpin 240, such that the base plate 285 or truck 250 do not need to be detached from the skateboard 280 to install the bracket 210. In the embodiment of FIG. 2, the bracket 210 is also aligned lengthwise with longitudinal axis 230, so that the lighting component 220 is oriented to project light forward of the skateboard 280. In other embodiments, the bracket 210 may be mounted such that it is aligned perpendicular to the direction shown in FIG. 2—that is, across the width of the skateboard—such that lights 220 illuminate the lateral sides of the board. In yet other embodiments, the bracket 210 may be designed so that the lighting components are oriented at an angle to the longitudinal axis 230 when loaded onto the bracket 210, to provide illumination to various areas surrounding the skateboard 280.

Figure 3:
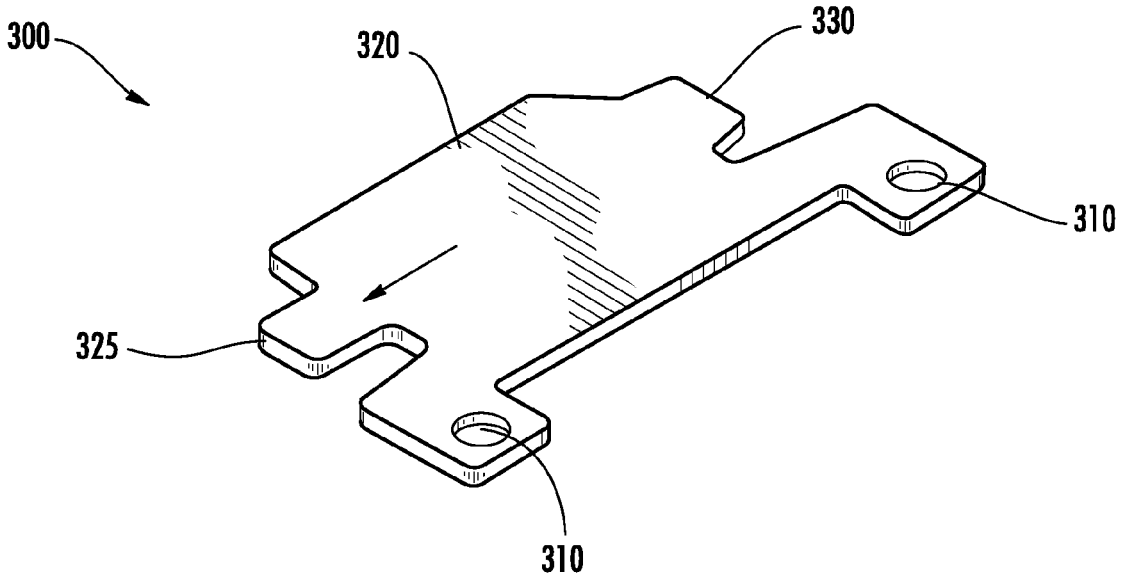
FIG. 3 is a top perspective view of an embodiment of a bracket for an accessory mounting assembly.

FIG. 3 shows a top perspective view of an exemplary embodiment of a bracket 300, which includes mounting holes 310, a plate 320, a tab 325 extending from the forward end of plate area 320, and a tab 330 extending from the rear. The bracket 300 is configured with mounting holes 310 that are aligned with standard mounting holes of the skateboard truck 250, so that the skateboard does not need to be modified in order to attach the accessory assembly. For example, the mounting holes of bracket 300 may be spaced 2.125" or 2.5" apart along the longitudinal axis of the skateboard, and 1.625" along the wide axis of the skateboard. The mounting holes 310 are also sized for standard hardware, such as bolts, of the skateboard truck. Tab 325 and tab 330 serve as receiving elements for an accessory component that will be coupled to the bracket 300. The accessory component is removably coupled to the bracket 300 by securing the accessory component onto tabs 325 and 330. Tabs 325 and 330 of plate 320 assist in aligning and securing the accessory component. In other embodiments, other types of receiving elements may serve to lock the lighting component in place. For example, the bracket 300 may have a receiving element that mates with a release mechanism, such as a magnetic or spring-loaded attachment, on the accessory component. The release mechanism enables an engaging element of the accessory component to be uncoupled from the receiving element of the bracket 300, thus allowing the accessory component to be removed from the bracket. In yet other embodiments, tabs 325 and 330 may instead be configured as other securing elements, such as snap-fit elements, friction fit elements, or the like.

Figure 4A:
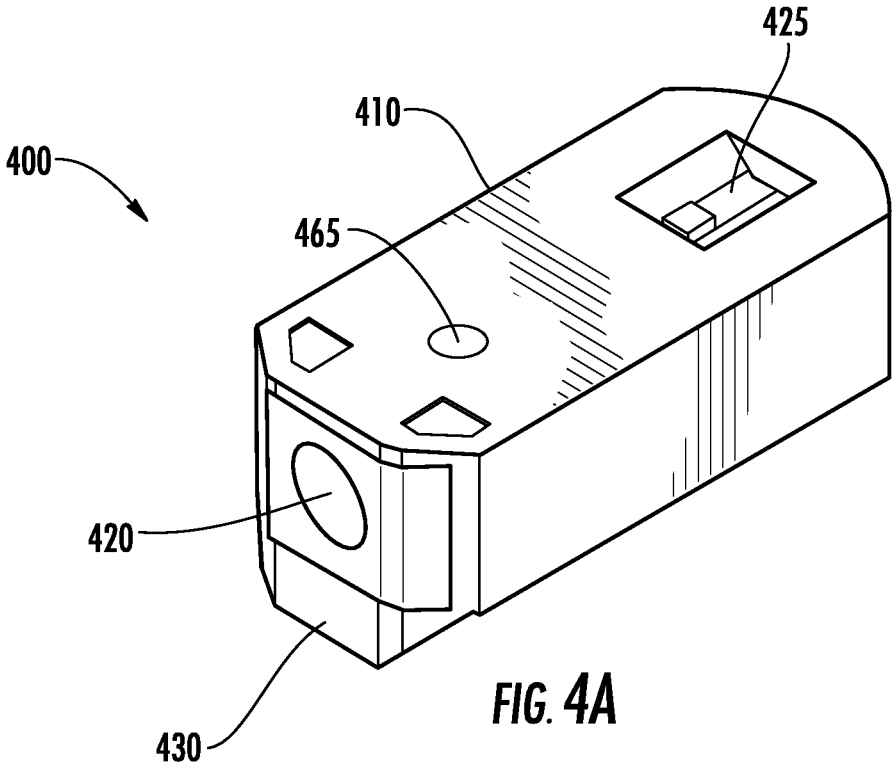
FIG. 4A is a top perspective view of an embodiment of a lighting component for a lighting assembly.

FIG. 4A is a top perspective view of an embodiment of a lighting component 400 that may be used with the bracket 300 of FIG. 3. Lighting component 400 includes a housing 410, with a lighting element 420 such as a light bulb or light emitting diode. In other embodiments, the housing 410 may be configured to hold a lighting element in other ways, such as having a cradle onto which a lighting element is affixed, or a hinged case into which the lighting element is mounted. Other accessories may be placed in housing 410 along with or instead of lighting element 420, such as a camera, a music device, navigation sensor (e.g., GPS device), or other electronic devices. Thus, the housing 410 may be configured to house one or more accessories. A light switch 425 on housing 410 controls the lighting element 420, where light switch 425 may be, for example, a sliding switch, a push button, or other type of control. Furthermore, light switch 425 may be configured to have more than one setting, such as low and high brightness.

Figure 4B:
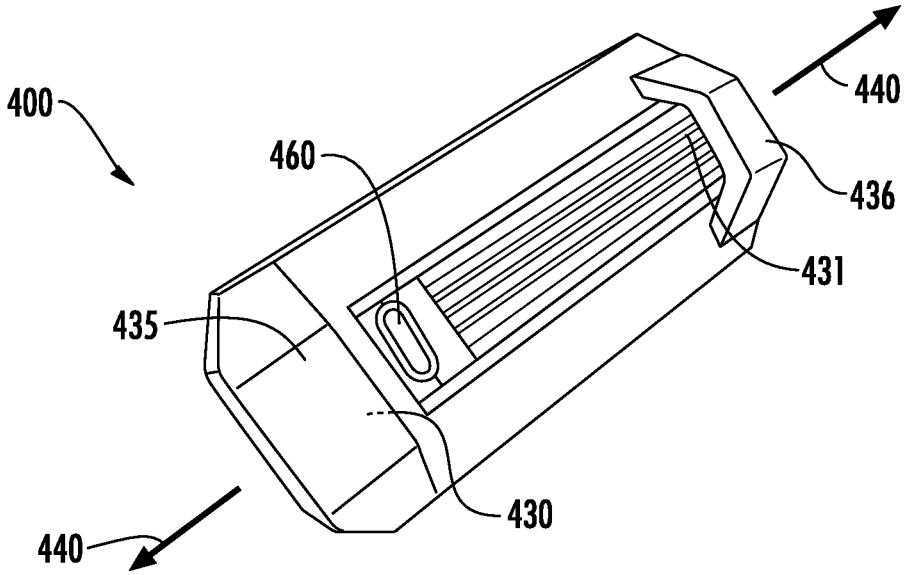
FIG. 4B is a bottom perspective view of the lighting component of FIG. 4A.

FIG. 4B shows a bottom perspective view of the underside of lighting component 400, which has engaging elements configured in this embodiment as slots 430 and slot 431 on the forward and rearward ends of the lighting component 400, respectively. Lighting component 400 may optionally include an electrical connection port 460, such as a mini-USB connector, for charging the lighting element 420. When the lighting component 400 plugged in, via a cable inserted into port 460, an optional indicator light 465 (FIG. 4A) may illuminate as a verification that the unit is charging.

In this embodiment, the lighting component 400 has a housing 410 that can be deformed slightly in order to mount the housing 410 onto tabs 325 and 330 of bracket 300. Housing 410, including the areas 435 and 436 that form the engaging elements (slots 430, 431), is made of a stretchable material such as, but not limited to, silicone rubber, natural rubber, thermoplastic elastomer, synthetic rubber, or other elastomeric materials. Thus, the housing 410 comprises a stretchable material forming the engaging element, the stretchable material enabling the engaging element to be deformed to couple to the receiving element. The user deflects the ends 435 and 436 away from each other indicated by arrows 440, thus moving the slots 430 and 431 apart slightly as the user places the lighting component 400 onto bracket 300. When the user releases the ends 435 and 436, the housing 410 resiliently returns to its unstretched state, thus securing the lighting component 400 onto bracket 300. Tab 325 of bracket 300 is inserted into slot 430, and tab 330 of bracket 300 is inserted into slot 431. Thus, the lighting component 400 is removably coupled to the receiving element of bracket 300. In this embodiment, the lighting component 400 may be easily removed from the bracket 300 by again deforming the ends 435 and 436 apart, allowing the tabs 325 and 330 to disengage from slots 430 and 431. Removal of the lighting component 400 allows the user to, for example, exchange the lighting component 400 for a different accessory, to recharge the unit, or to replace batteries. The bracket 300 remains mounted to the skateboard after the lighting component 400 is removed, so that it is in place for re-mounting of an accessory at a future time. That is, the engaging element of the housing and the receiving element of the bracket are removably coupled such that the bracket remains mounted to the skateboard when the housing is uncoupled from the bracket. Note that in this disclosure, the terms receiving element and engaging element generally refer to two elements that mate together, and can be interchanged regarding which element is located on the housing or bracket. Similarly, either the receiving element or engaging element may be configured with male or female coupling elements.

Figure 5B:
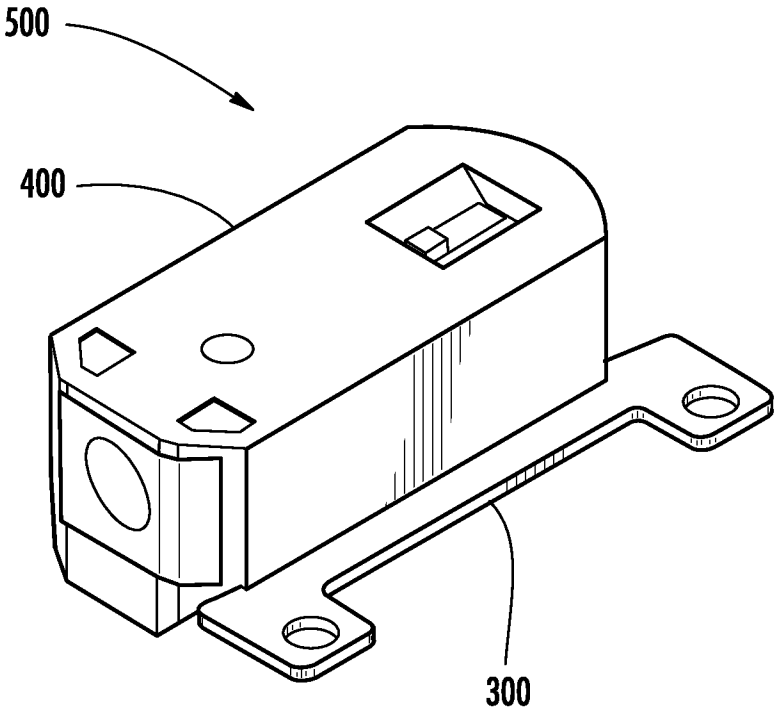
FIG. 5B shows a top perspective view of the bracket of FIG. 3 and the lighting component of FIGS. 4A-4B coupled together.
Figure 5A:
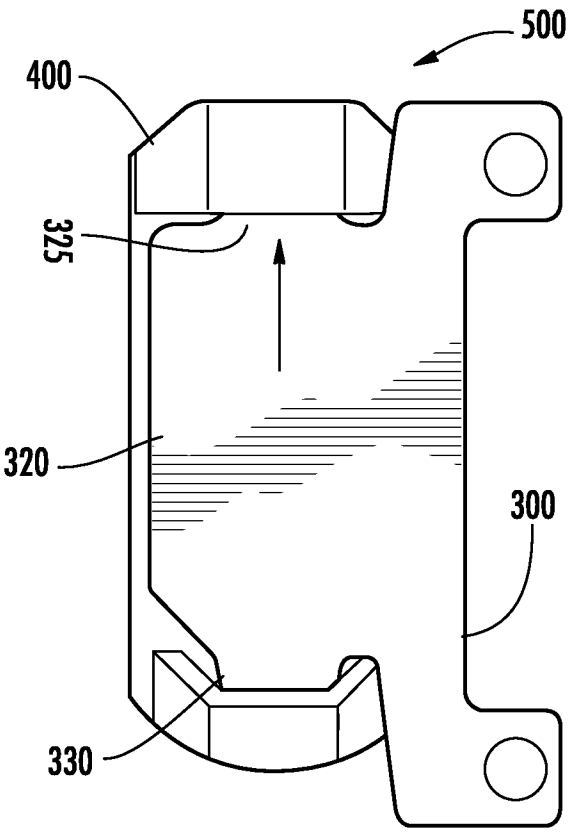
FIG. 5A shows a bottom view of the bracket of FIG. 3, with the lighting component of FIGS. 4A-4B mounted to it.

FIGS. 5A and 5B show a lighting assembly 500 in which the lighting component 400 is coupled to bracket 300. FIG. 5A is a bottom view, showing the back side of the bracket 300 that would be mounted to the first surface of a base plate of a skateboard. FIG. 5B is a top perspective view of the lighting assembly 500. In FIGS. 5A and 5B, the lighting component 400 has been coupled to bracket 300, and tabs 325 and 330 of plate 320 have locked lighting component 400 into place. Although the receiving and engaging elements are configured as tabs 325/330 and slots 430/431, respectively, in this embodiment, the lighting component 400 and bracket 300 may be coupled by other techniques in other embodiments. For example, the bracket 300 and lighting component 400 may be removably coupled by snapping the components onto each other, using magnetic coupling elements, or by rotating components utilizing threaded elements.

Figure 6:
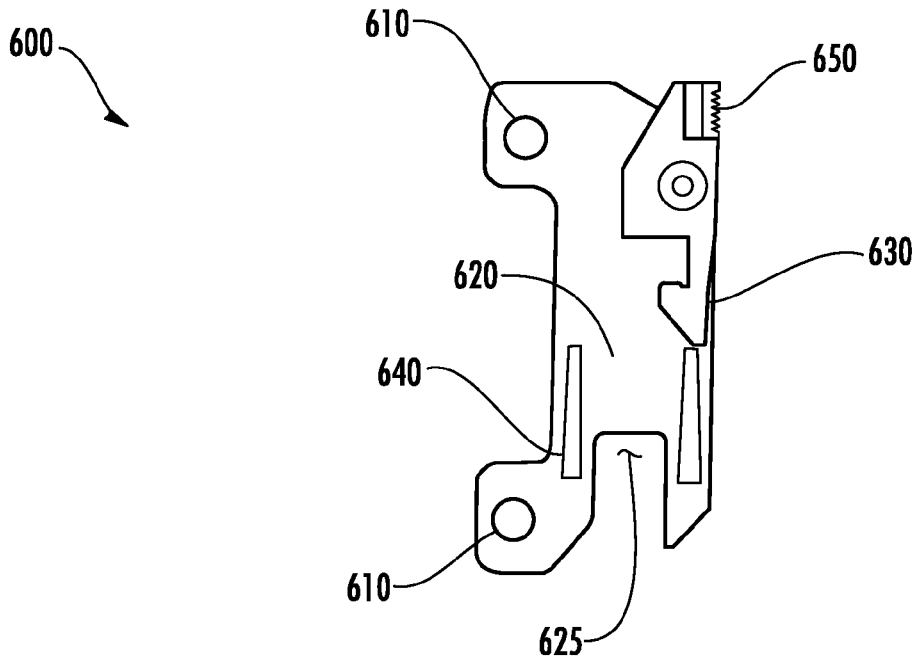
FIG. 6 is a top view of another embodiment of a bracket for an accessory mounting assembly.
Figure 7:
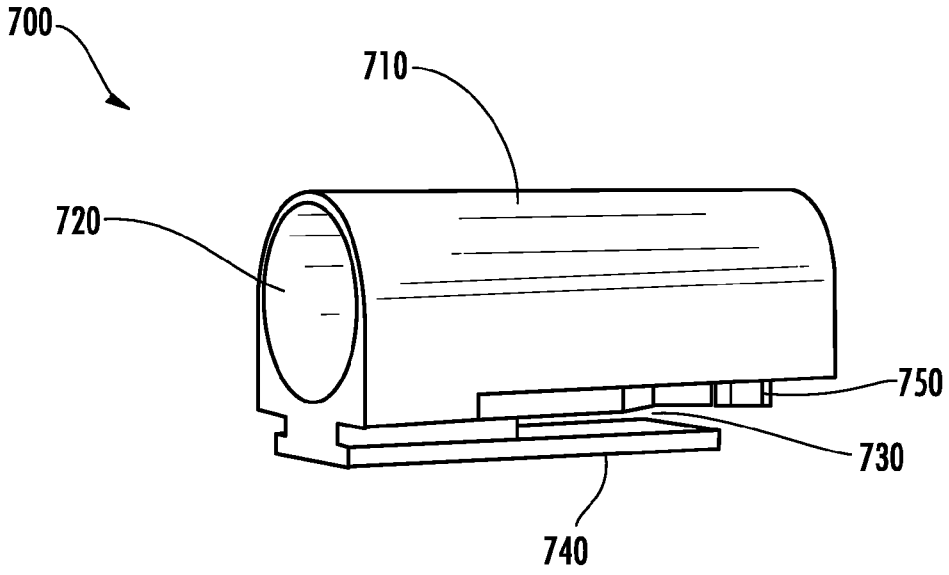
FIG. 7 is a side perspective view of another embodiment of a lighting component for a lighting assembly.
Figure 8:
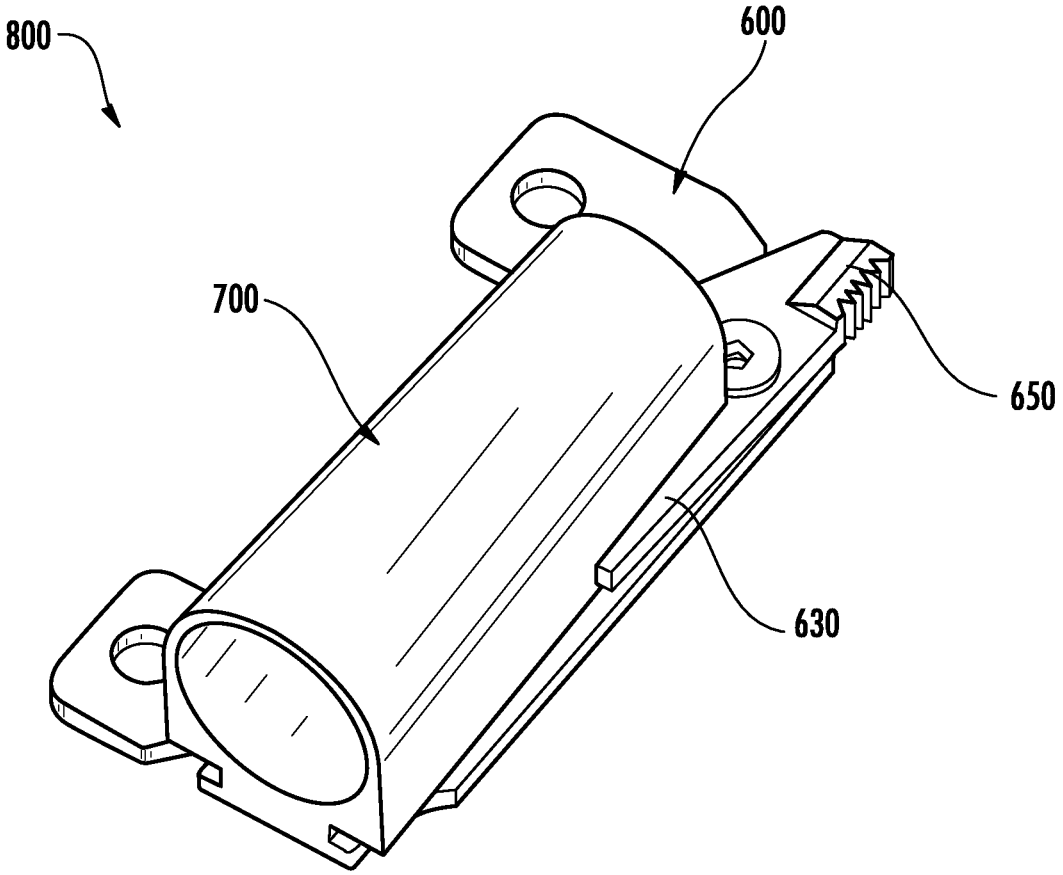
FIG. 8 shows a top perspective view of the bracket of FIG. 6 and the lighting component of FIG. 7, coupled together.

FIGS. 6-8 show another embodiment of an assembly for mounting an accessory component, where in this embodiment the bracket includes a release mechanism. FIG. 6 shows a top view of a bracket 600, which includes mounting holes 610, a plate 620, a cut-out 625 in the plate area, and a pivoting hook 630. Plate 620 and cut-out 625 serve as receiving elements for an accessory component that will be coupled to the bracket 600. The accessory component is removably coupled to the bracket 600 by sliding it onto the plate 620, guided by rails 640. In other embodiments, rails 640 may be configured as grooves or guiding pines. Cut-out 625 in plate 620 assists in aligning and securing the accessory component. Hook 630 serves to lock the accessory component in place, being configured as a spring-loaded lever in this embodiment. To release the accessory component, a user depresses release area 650 on the opposite end of hook 630. In other embodiments, hook 630 may be instead be configured as other securing elements, such as a button release, hinged arms that wrap around the accessory component, snap-fit elements, a magnetic lock, friction fit elements, or other mechanical elements.

FIG. 7 is a perspective view of an embodiment of a lighting component 700 that may be used with the bracket 600 of FIG. 6. Lighting component 700 includes a housing 710 with a cavity 720 into which an accessory—for example, a lighting element such as a bulb or light emitting diode—can be inserted. In other embodiments, the housing 710 may be configured to mount a lighting element or accessory in other ways, such as having a cradle onto which a lighting element is affixed, or a hinged case into which the lighting element is mounted. Also incorporated with housing 710 in FIG. 7 is an engaging element, configured in this embodiment as an open slot 730 with a bottom plate 740. Plate 620 of bracket 600 (FIG. 6) is inserted into slot 730, and hook 630 of bracket 600 engages a lip 750 on the underside of housing 710. Thus, the lighting component 700 is removably coupled to the receiving element of bracket 600, such that the lighting component 700 may be easily removed from the bracket 600. For example, a user may remove the lighting component 700 during the daytime when lighting is not needed, or for repair of components.

FIG. 8 shows a lighting assembly 800 in which the lighting component 700 is coupled to bracket 600. The lighting component 700 has been slid onto bracket 600, and hook 630 has locked lighting component 700 into place. Release area 650 of bracket 600 is easily accessible for a user to depress and unlock the lighting component 700 for removal. Note that the receiving and engaging elements—configured as slot 730 and plate 620 with cut-out 625 in this embodiment—may be coupled by methods other than a sliding action. For example, in other embodiments the bracket 600 and lighting component 700 may be removably coupled by snapping components onto each other, or by rotating components utilizing threaded elements.

Figure 9:
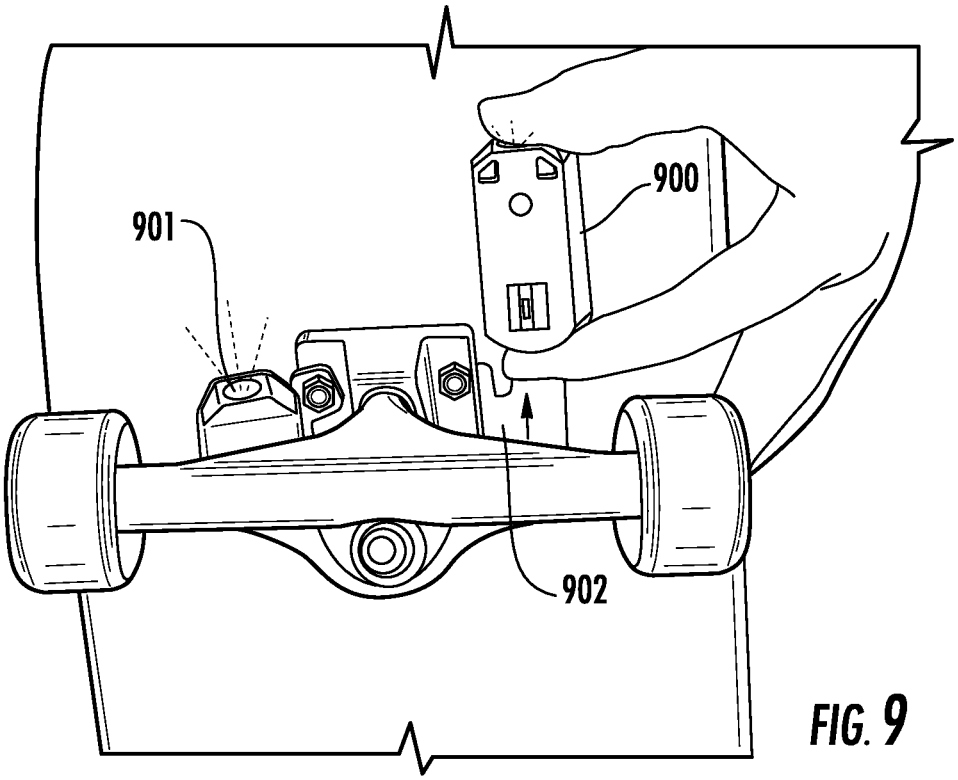
FIG. 9 shows a user loading a lighting component onto a skateboard.

FIG. 9 illustrates a user holding a lighting component 900 that is ready to be loaded onto a skateboard, where a first light 901 has already been installed on the opposite edge of the truck's base plate. A bracket 902, such as bracket 300 or bracket 600 of the previous figures, is already in place on the skateboard truck to receive lighting component 900. The bracket 902 has been mounted onto the skateboard using only the existing hardware of the skateboard, and without needing to remove any components of the truck area. Consequently, the lighting component 900 can be taken on or off the board at anytime without disturbing the bracket 902, the truck area, or other components of the skateboard.

Figure 10:
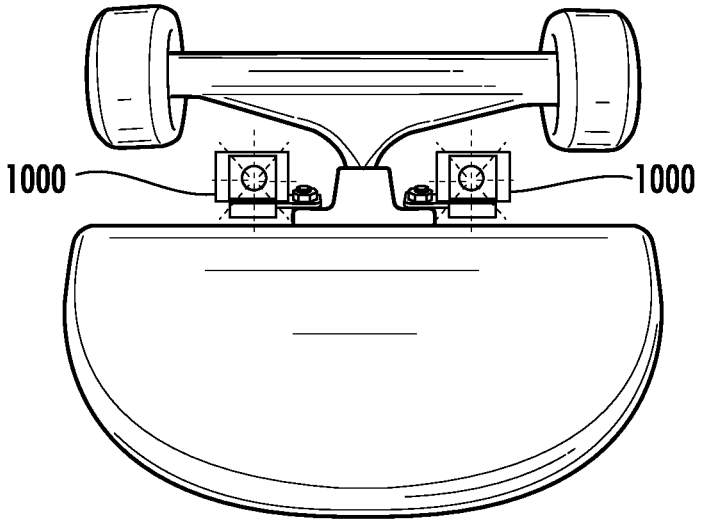
FIG. 10 shows a front view of a lighting assembly installed on a skateboard.

FIG. 10 shows lighting components 1000 mounted onto a skateboard, illustrating the forward direction of the lights. By being positioned in the truck area, the lights are protected by the truck and wheels, such as for shock resistance. The lighting components 1000 also consequently do not interfere with the availability of the remaining portions of the deck for performing tricks. The lighting components 1000 in this embodiment may have multiple lights, and can be configured with an illumination range that extends beyond the front edge of the skateboard so that a user may see the surface ahead of where they are riding.

Figure 11A:
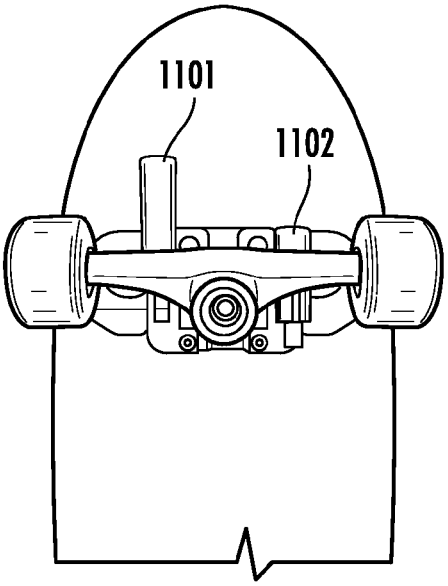
FIGS. 11A-11D provide bottom views of a skateboard in various stages of installation and usage of a lighting assembly.
Figure 11B:
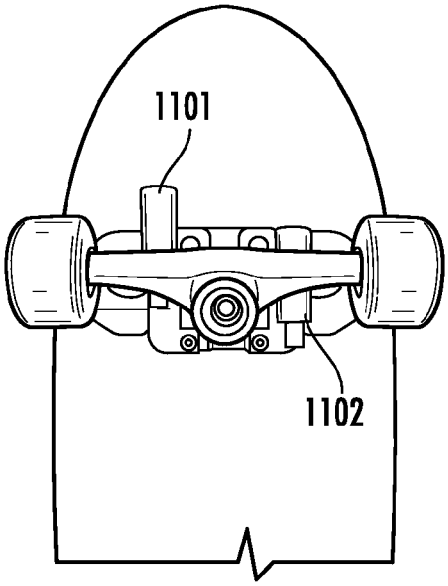
Figure 11C:
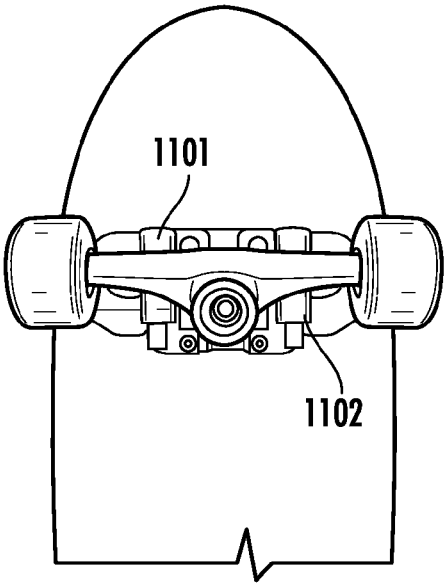
Figure 11D:
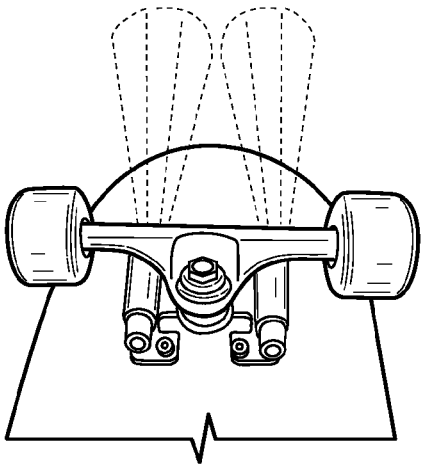

FIGS. 11A-11D show bottom views of an accessory mounting assembly in various stages of installation and usage, in an embodiment where the lighting component is slid on. For example, the accessory assemblies of FIG. 8 is represented here. In FIG. 11A, one lighting component 1101 is ready to be installed while a second lighting component 1102 is already installed onto a skateboard. In FIG. 11B, the lighting component 1101 is partially slid onto the bracket (not seen in this view). In FIG. 11C, both lighting components 1101 and 1102 are fully mounted, being coupled onto their respective brackets. In FIG. 11D, the lighting components 1101 and 1102 are turned on, thus providing illumination for the rider. FIG. 11D shows the visibility of the lights in a dark environment, and how the lights project forward of the skateboard in this embodiment. Although two lighting components 1101 and 1102 are shown in FIGS. 11A-11D, in other embodiments only one lighting assembly may be used. In other embodiments, more than two lighting assemblies may be used, such as to direct light outward at different angles. Furthermore, the lighting assemblies may be mounted on the front and/or rear truck of the skateboard. For example, rear lights may be used to provide visibility of the skateboard to vehicles approaching from behind the rider.

Figure 12:
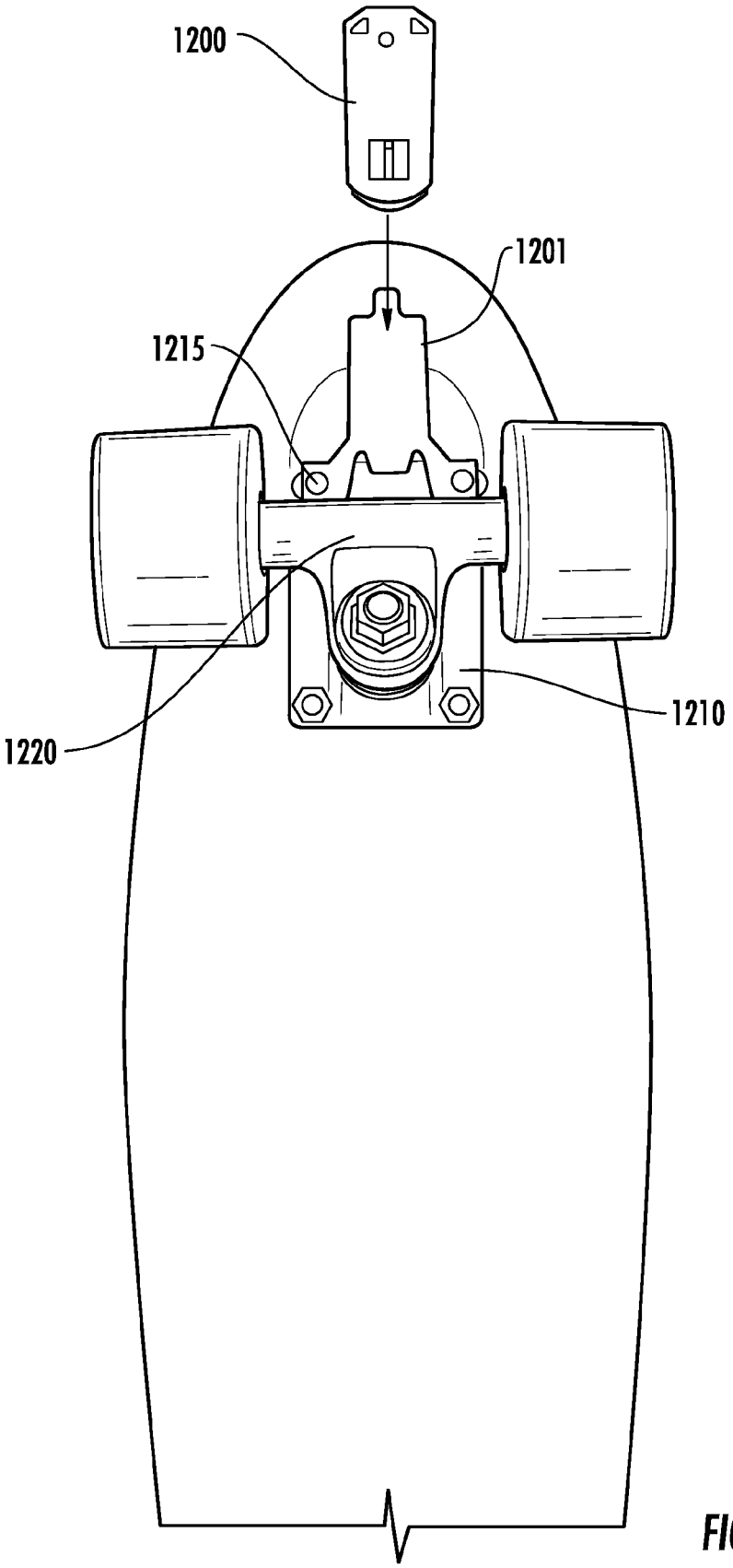
FIG. 12 shows a bottom view of an embodiment in which a bracket and a single accessory component are mounted forward of the base plate and truck of a skateboard.

FIG. 12 shows a bottom view of a light assembly attached to a small skateboard. In this embodiment, a bracket 1201 is mounted to the front bolts 1215 of the base plate 1210 such that the bracket 1201, to which the lighting component 1200 will be mounted, is forward of the truck assembly 1220. The bracket 1201 is configured with mounting holes that are aligned with the standard mounting holes and sized for standard hardware of the skateboard truck. The bracket 1201 is embodied with tabs similar to bracket 300 of FIG. 3, to secure lighting component 1200 into the bracket 1201. The lighting component 1200 will not interfere with riding performance of the skateboard even though the lighting component 1200 protrudes in front of the truck assembly 1220. The single bracket design 1201 and single lighting component 1200 will provide adequate light in a dark environment, projecting light in front of the small skateboard. The lighting assembly 1200 may project light in front, behind, or underneath the skateboard for full visibility.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the scope of the present invention. Furthermore, those of ordinary skill in the art will appreciate that the foregoing description is by way of example only, and is not intended to limit the invention. Thus, it is intended that the present subject matter covers such modifications and variations.

What is claimed is:

1. An accessory assembly for a skateboard, comprising:

a) a bracket configured to be mounted to a first surface of a base plate of a skateboard truck, wherein the first surface is opposite a second surface of the base plate, the second surface facing a deck of the skateboard when mounted to the skateboard;

wherein the bracket is configured to be mounted onto the first surface of the base plate without removing the skateboard truck from the skateboard, the bracket comprising:

a mounting hole; and a receiving element; and b) an accessory component comprising:

a housing having an engaging element, the engaging element being configured to be removably coupled with the receiving element; and an accessory mounted to the housing.

2. The accessory assembly of claim 1, wherein the skateboard has a longitudinal axis, and wherein the bracket is configured to be located on only one side of the longitudinal axis.

3. The accessory assembly of claim 1, wherein the bracket is configured to be mounted forward of the base plate.

4. The accessory assembly of claim 1, wherein the receiving element comprises a tab, and the engaging element comprises a slot into which the tab is inserted.

5. The accessory assembly of claim 4, wherein the housing comprises a stretchable material forming the engaging element, the stretchable material enabling the engaging element to be deformed to couple to the receiving element.

6. The accessory assembly of claim 1, wherein the receiving element and the engaging element are removably coupled by a sliding action.

7. The accessory assembly of claim 1, wherein the bracket comprises a release mechanism enabling the engaging element and the receiving element to be uncoupled.

8. The accessory assembly of claim 1, wherein the accessory is chosen from the group consisting of: a lighting element, a camera, an audio device, and a navigation sensor.

9. The accessory assembly of claim 1, wherein the accessory component is a light having an illumination range that extends beyond a front edge of the skateboard.

10. The accessory assembly of claim 1, wherein the bracket is configured with mounting holes that are aligned with standard mounting holes of the skateboard truck.

11. A lighting assembly for a skateboard, comprising:

a) a bracket configured to be mounted to a first surface of a base plate of a skateboard truck, wherein the first surface is opposite a second surface of the base plate, the second surface facing a deck of the skateboard when mounted to the skateboard;

wherein the bracket is configured to be mounted onto the first surface of the base plate without removing the skateboard truck from the skateboard, the bracket comprising:

a mounting hole; and a receiving element; and b) a lighting component comprising:

a housing having an engaging element, the engaging element being configured to be removably coupled with the receiving element; and a lighting element mounted to the housing.

12. The lighting assembly of claim 11, wherein the bracket is configured to be mounted onto the first surface of the base plate such that the base plate is between the bracket and the deck when the bracket is mounted to the skateboard.

13. The lighting assembly of claim 11, wherein the bracket is configured to span only a portion of a perimeter of the base plate.

14. The lighting assembly of claim 11, wherein the engaging element of the housing and the receiving element of the bracket are removably coupled such that the bracket remains mounted to the skateboard when the housing is uncoupled from the bracket.

15. A lighting assembly for a skateboard, comprising:

a) a bracket having a receiving element;

b) a lighting component comprising:

a housing having an engaging element, the engaging element being configured to be removably coupled with the receiving element; and a lighting element mounted to the housing; and c) a coupling element configured to mount the bracket to a first surface of a base plate of a skateboard truck, wherein the first surface is opposite a second surface of the base plate, the second surface facing a deck of the skateboard;

wherein when the bracket is being mounted to the first surface of the base plate, the skateboard truck is not removed from the skateboard.

16. The lighting assembly of claim 15, wherein the base plate is between the bracket and the deck when the bracket is mounted to the skateboard.

17. The lighting assembly of claim 15, wherein the bracket is configured to span only a portion of a perimeter of the base plate.

18. The lighting assembly of claim 15, wherein the coupling element comprises mounting holes on the bracket, the mounting holes being aligned with standard mounting holes of the skateboard truck and sized for standard hardware of the skateboard truck.

19. The lighting assembly of claim 15, wherein the receiving element comprises a tab, and the engaging element comprises a slot into which the tab is inserted.

* * * * *